US005924906A

United States Patent [19]

Grafton

[11] Patent Number: 5,924,906

[45] Date of Patent: Jul. 20, 1999

[54] PIN CONNECTOR FOR CONSTRUCTION TOY SET

[75] Inventor: Charles E. Grafton, El Segundo, Calif.

[73] Assignee: Mattel, Inc., El Segundo, Calif.

[21] Appl. No.: 09/020,022

[22] Filed: Feb. 6, 1998

[51] Int. Cl.[6] ..... A63H 33/06; A63H 33/08; F16B 19/00; F16B 21/00

[52] U.S. Cl. ..... 446/121; 446/105; 446/124; 411/508; 411/339

[58] Field of Search ..... 446/120, 121, 446/105, 106, 102, 103, 104, 124, 126, 127; 24/115 M, 575; 411/508, 339

[56] References Cited

U.S. PATENT DOCUMENTS

| | | | |
|---|---|---|---|
| 2,238,039 | 4/1941 | De Witt . | |
| 2,523,239 | 9/1950 | Tinnerman | 411/508 |
| 2,799,118 | 7/1957 | Lullo . | |
| 2,885,822 | 5/1959 | Onanian . | |
| 3,074,203 | 1/1963 | Paksy | 446/120 |
| 3,205,611 | 9/1965 | Onanian . | |
| 3,603,026 | 9/1971 | Kishigami | 446/124 X |
| 3,613,291 | 10/1971 | Howe | 446/103 |
| 3,694,954 | 10/1972 | Brumlik . | |
| 4,160,337 | 7/1979 | Fischer | 446/124 X |
| 4,202,132 | 5/1980 | Fischer . | |
| 4,246,718 | 1/1981 | Chatani . | |
| 4,614,502 | 9/1986 | Nelson . | |
| 5,000,713 | 3/1991 | Cheng . | |
| 5,199,919 | 4/1993 | Glickman . | |
| 5,238,438 | 8/1993 | Glickman . | |
| 5,282,767 | 2/1994 | Gelardi . | |
| 5,306,198 | 4/1994 | Forman . | |
| 5,372,450 | 12/1994 | Blodgett . | |
| 5,402,773 | 4/1995 | Radna . | |

FOREIGN PATENT DOCUMENTS

| | | | |
|---|---|---|---|
| 1062530 | 4/1954 | France | 446/120 |
| 21755 | 9/1924 | United Kingdom | 446/127 |

*Primary Examiner*—D. Neal Muir
*Attorney, Agent, or Firm*—Roy A. Ekstrand

[57] ABSTRACT

A construction toy set includes a plurality of interconnectable toy set elements such as couplers for beams which define respective sockets or bores therein. A pin connector defines a generally cylindrical collar supporting a pair of outwardly extending oppositely directed generally cylindrical pins which are receivable within the bores and sockets of the construction toy elements. The pins of the pin connectors each define an elongated expansion groove and an elongated rib extending substantially the length of the pins. The expansion grooves and ribs deform due to the resilient plastic material of the pin during pin insertion into the cooperating bores and/or sockets of the construction toy elements to allow the pins to deform and provide a snug but pivotable fit therebetween.

1 Claim, 1 Drawing Sheet

10
2
2
11
12
13
14
23
22
24
40
30
31
32
33
34
35
36
37
38

10
11
12
13
14
30
31
32
33
35
36

10
11
12
13
14

10
11
12
13
14
22
23
24
45
46
47
48
49
50
55

60
61
62
63
64

PIN CONNECTOR FOR CONSTRUCTION TOY SET

FIELD OF THE INVENTION

This invention relates generally to construction toy sets and particularly to interconnecting elements used therein to form complex operative structures.

BACKGROUND OF THE INVENTION

Construction toy sets have enjoyed great popularity for many years and are particularly appreciated for their developmental and educational value as well as their amusement and play value. From the outset, such construction toy sets have been provided in a virtually endless variety of structures. However, all generally have included a plurality of interconnecting or interlocking elements which may be creatively combined to form relatively complex structures. Refinements have included the use of elongated beam elements together with interlocking coupling or connection elements as well as the provision of various operative mechanisms such as gear motor drives, cord pulley drives, and hand crank or windup drive elements. The interconnection of construction toy set elements have themselves been the subject of substantial variation and development. More recently, such construction toy sets have been provided using a multiplicity of elements formed of molded plastic material. Thus while initially formed of relatively simple metal or wooden interlocking elements, construction toy sets have become relatively sophisticated and complex in their structures due to the intricacies of plastic molding techniques.

For example, U.S. Pat. No. 5,199,919 issued to Glickman sets forth a CONSTRUCTION TOY SYSTEM having a variety of molded plastic connector elements arranged to be joined with rod-like struts to form complex structural units. In the most basic form, the connector elements have one or more angularly related strut receiving recesses each arranged for lateral snap-in reception of a flanged strut.

U.S. Pat. No. 5,238,438 issued to Glickman sets forth a CONSTRUCTION TOY AND ADAPTER related to the above Glickman patent in which a snowflake-like connector defines a plurality of end receiving receptacles which releasably secure a corresponding plurality of struts to form a hub-like connector.

U.S. Pat. No. 2,238,039 issued to DeWitt sets forth a TOY LOG STRUCTURE having a plurality of elongated cylindrical "logs" each defining interlocking notches proximate the ends thereof. The log elements may be interlockingly coupled to form right angle connections suitable for fabricating a dwelling or the like.

U.S. Pat. No. 3,694,954 issued to Brumlik sets forth a CONSTRUCTION ELEMENT FOR THE ASSEMBLY OF MODELS AND THE LIKE comprising a pair of matable segments interconnected by a flexible strip. The segments join to form the element which has an elongated end adapted to receive and mount a tube and a bulbous end. The strap can be positioned to surround a structural member to maintain the elements in a selected locus with respect to the structural member.

U.S. Pat. No. 4,246,718 issued to chatani sets forth an INTERCONNECTING TOY BLOCK ARRANGEMENT having frictional interconnecting toy blocks each defining an interior body cavity. The interconnection of toy blocks is achieved by a female coupler on each block extending through the cavity of an adjacent block.

U.S. Pat. No. 5,282,767 issued to Gelardi sets forth a CONSTRUCTION SET WITH INJECTION MOLDED AND EXTRUDED TUBE BEAMS in which straight and curved tube beams are formed having end joints separated from the elongated bodies thereof by flanges. The flanges are created to prevent the beams from pushing through when connected to connectors.

U.S. Pat. No. 5,000,713 issued to Cheng sets forth COMBINABLE TOY BLOCKS having two different types of units, both of which are cubic in shape. The first unit type has a protuberance formed on at least one surface thereof and a depression is formed on each respective remaining surface thereof. The second unit has a depression formed on each surface thereof. The different types are fitted together by the extension of the protuberance into a depression on an adjacent block.

U.S. Pat. No. 5,306,198 issued to Forman sets forth a TOY BUILDING BLOCK ASSEMBLY having a variety of block-like members arranged for assemblage relative to one another.

U.S. Pat. No. 5,372,450 issued to Blodgett sets forth a FLEXIBLE JOINT CONNECTOR for releasably joining a selected number of tiles together wherein each tile includes a plurality of receptacles adapted to snap lock with a retaining element used in common with other tiles to provide a composite object.

U.S. Pat. No. 4,614,502 issued to Nelson sets forth TELESCOPING STRUT MEMBERS AND TENDONS FOR CONSTRUCTING TENSILE INTEGRITY STRUCTURES in which a plurality of elongated cylindrical rods are interconnected by a plurality of flexible string elements to form complex structures.

U.S. Pat. No. 4,202,132 issued to Fischer sets forth a HOLLOW STRUCTURAL ELEMENT having a circumferential wall and sidewall which closes over one of the axial ends of the circumferential wall and a cover member arranged to close the remaining end of the circumferential wall for connecting the structural element with other structural elements.

U.S. Pat. No. 3,205,611 issued to onanian sets forth HOLLOW BLOCKS AND TUBULAR CONNECTING MEANS THEREFOR having a plurality of interconnecting blocks each adapted to receive one or more cylindrical rods to form complex structures. In a related patent 2,885,822 also issued to Onanian, a CONSTRUCTION SET having interconnectable straight and curved elements is shown.

U.S. Pat. No. 2,799,118 issued to Lullo sets forth a TOY BUILDING STRUCTURE having a plurality of interconnectable elongated elements for forming lattice-like building structures.

U.S. Pat. No. 5,402,773 issued to Radna sets forth an AUXILIARY SURGICAL RETRACTOR SYSTEM in which a plurality of blade members are connectable in series by connector elements.

While the foregoing described prior art devices have improved the construction toy art, and in some instances have enjoyed commercial success, there remains nonetheless a continuing need in the art for evermore improved, simple, low cost and easy to manufacture elements for use in construction toy sets.

SUMMARY OF THE INVENTION

Accordingly, it is a general object of the present invention to provide an improved connector for use in a construction toy set. It is a more particular object of the present invention to provide an improved element for a construction toy set which is easily assembled and which provides stability of attachment while facilitating pivotal motion between connected elements.

In accordance with the present invention, there is provided a construction toy set having a plurality of couplers each defining a bore therein, a pin connector comprising a generally cylindrical collar having first and second faces and an outer surface, a first pin defining a first elongated generally cylindrical body extending from the first face and having a first expansion groove formed in the first elongated generally cylindrical body and a first expansion rib formed upon the first elongated generally cylindrical body and a second pin defining a second elongated generally cylindrical body extending from the second face and having a second expansion groove formed in the second elongated generally cylindrical body and a second expansion rib formed upon the second elongated generally cylindrical body, the first and second pins being insertable into the bores of a pair of couplers to form a pivotable attachment therebetween.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENTS

Figure 1:
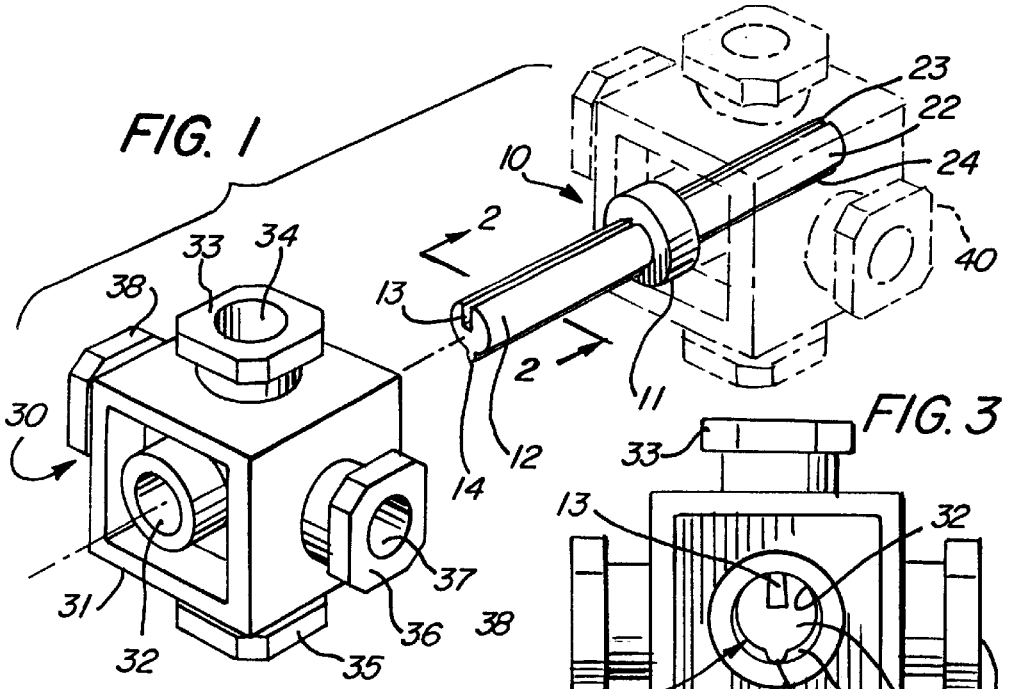
FIG. 1 sets forth a perspective assembly view of a pin connector for construction toy set constructed in accordance with the present invention together with an exemplary interconnecting toy element.

FIG. 1 sets forth a perspective assembly view of a pin connector for construction toy set constructed in accordance with the present invention and generally referenced by numeral 10. Also shown in the assembly view of FIG. 1 is a conventional construction toy coupler 30 shown in solid line representation and aligned for assembly to pin connector 10. Further shown in FIG. 1 in dashed line representation is a second substantially identical cooperating coupler generally referenced by numeral 40. Coupler 40 is assembled to pin connector 10 and is shown in dashed line representation to facilitate the viewing of pin connector 10 in its assembled position to a conventional coupler.

More specifically, pin connector 10 includes a generally cylindrical collar 11 and a pair of outwardly extending oppositely positioned generally cylindrical pins 12 and 22. Pin 12 defines an elongated expansion groove 13 extending substantially the entire length of pin 12 together with an oppositely positioned elongated rib 14. In the preferred fabrication of the present invention, rib 14 is positioned in alignment with and in opposite orientation to expansion groove 13.

Figure 3:
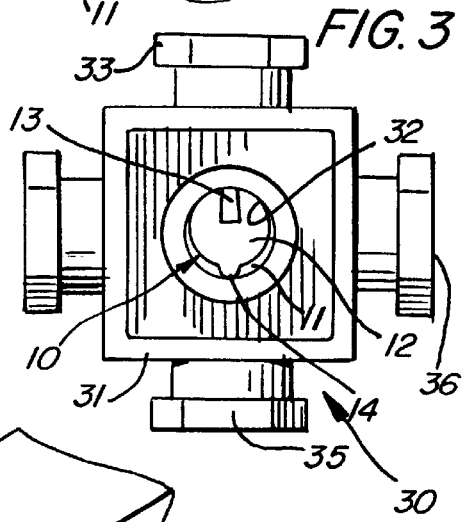
FIG. 3 sets forth a front view of the present invention pin connector within the coupling element of FIG. 1.

Pin 22 defines an expansion groove 23 and an oppositely positioned rib 24. In the preferred fabrication of the present invention, pin connector 10 is fabricated of a somewhat rigid, but slightly resilient material such as molded plastic or the like. The quality of resilience is desirable in that an important aspect of the present invention connector is provided by the ability of ribs 14 and 24 to deform slightly as their respective (pins 12 and 22) are received within a cooperating bore such as bore 32 of coupler 30. Further, the resilient characteristic of pins 12 and 22 further allow expansion grooves 13 and 23, respectively therein, to be deformed during the insertion of pins 12 and 22 into bore 32 or other cooperating bores of different construction toy set elements. This deformation characteristic of the pin portions of connector 10 is illustrated in FIG. 3.

Coupler 30 is, as mentioned above, constructed in accordance with conventional fabrication and is preferably formed of a molded plastic material and defines a generally cubic body 31. In accordance with its intended use as a structural element coupler, coupler 30 supports a quartet of outwardly spaced coupling flanges 33, 35, 36 and 38. The coupling flanges cooperate with corresponding structural elements such as beam element 45 (shown in FIG. 4). Thus by use of coupler 30, a plurality of interlocking construction toy set elements such as beams or other elements may be interlockingly secured to the coupler forming a complex structure.

In further accordance with the fabrication of coupler 30, a plurality of bores extend through the coupler at various angles to facilitate the reception of shaft elements or the like. Thus coupler 30, in further accordance with its conventional fabrication, defines a center bore 32 together with similar bores 34, 37 and the like extending through the coupler flanges and coupler body 31. Coupler 40 shown in dashed line representation will be understood to be substantially identical to coupler 30.

In accordance with the present invention, a pair of elements such as couplers 30 and 40 may be mutually joined by the present invention pin connector through the insertion of pin 12 through bore 32 of coupler 30 and the insertion of pin 22 through the corresponding bore within coupler 40. The combined structure thus provided is snugly coupled in that expansion grooves 13 and 23 together with ribs 14 and 24 deform and thereby provide the snug, tight fit illustrated in FIG. 3. In further accordance with the present invention, collar 11 acts as a spacer between couplers 30 and 40 when secured to pin connector 10 providing a predictable space therebetween. It will be apparent to those skilled in the art that while a cylindrical shape is shown for collar 11, its essential function as a spacer between pins 12 and 22 may be accomplished by using other differently shaped collars such as square, rectangular, oval and so on.

In further accordance with an important aspect of the present invention, the snug coupling between pins 12 and 22 within couplers 30 and 40 is sufficient to secure the couplers but is, however, a pivotable attachment. Thus elements secured to coupler 30 are rotatably supported with respect to construction toy elements secured to coupler 40. The result is a simple, yet reliable fabrication which secures couplers 30 and 40 in a pivotal attachment while securely maintaining their positions clue to the elastic character of the elongated grooves and ribs within each of the pins.

Figure 2:
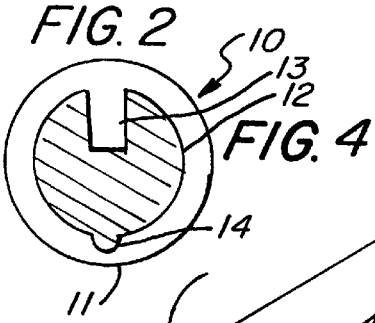
FIG. 2 sets forth a section view of the pin connector of FIG. 1 taken along section lines 2—2 therein.

FIG. 2 sets forth a section view of pin connector 10 taken along section lines 2—2 in FIG. 1. As described above, pin connector 10 includes a generally cylindrical collar 11 supporting a generally cylindrical pin 12. As is also described above, pin 12 defines an elongated expansion groove 13 together with an outwardly extending elongated rib 14. The function of rib 14 is to provide a snug fit against the inner bore or passage surfaces within which pin 12 is inserted during assembly. Similarly, expansion groove 13 allows a small inward deformation of pin 12 which resiliently secures pin 12 within its assembled bore in the manner described in FIG. 3.

FIG. 3 sets forth an assembly view of pin connector 10 secured within coupler 30 in the above-described assembly. Thus as set forth above, coupler 30 defines a generally cubic body 31 having a plurality of outwardly extending coupler flanges 33, 35, 36 and 38. Coupler 30 also defines a bore 32 extending through body 31 at the approximate center thereof.

In accordance with the present invention, pin 12 of pin connector 10 is shown inserted into bore 32 of coupler 30 in a typical assembly. During this insertion, the relative size of pin 12 and bore 32 causes pin 12 to deform slightly to accommodate a press fit within bore 32. Thus, as is shown, expansion groove 13 is deformed slightly while rib 14 is also slightly compressed, the combination of which allows pin 12 to be tightly received within bore 32. The resilient character of the molded plastic material from which pin 12 is preferably formed causes expansion groove 13 to maintain an outward or expansive pressure from its deformed configuration thereby exerting an outward frictional force against the interior walls of bore 32. Correspondingly, the compression or deformation of rib 14 caused during the insertion of pin 12 within bore 32 produces a similar outward expansive force against the interior surface of bore 32. The combined result is the maintenance of a secure coupled force between pin 12 which may be overcome in order to provide smooth pivotal motion to alternate angular positions of coupler 30.

Figure 4:
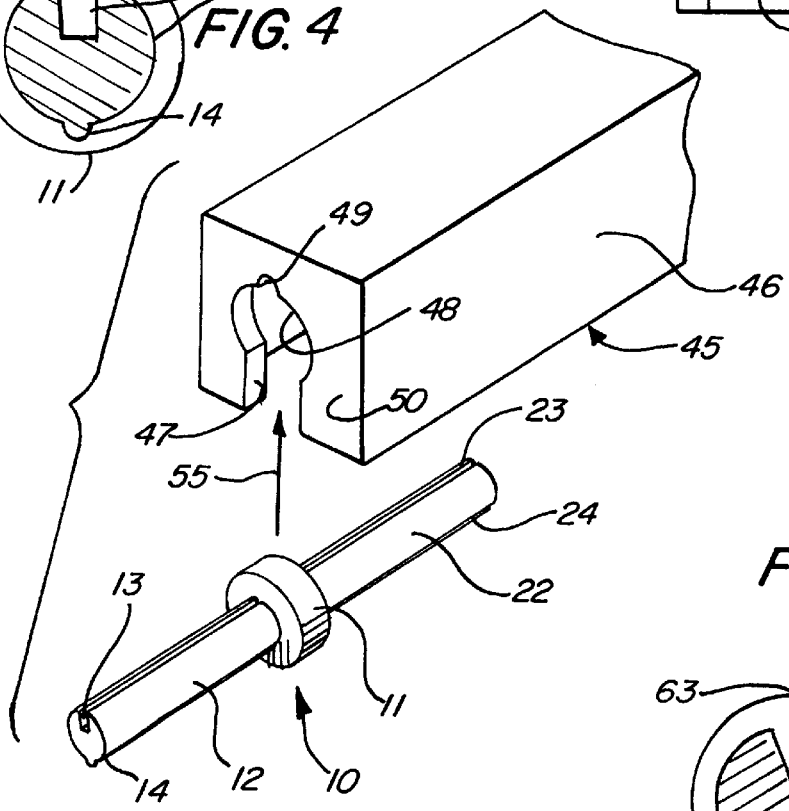
FIG. 4 sets forth a partial assembly view of the present invention pin connector combined with an exemplary beam element.

FIG. 4 sets forth a partial perspective assembly view of pin connector 10 together with a conventional construction toy beam generally referenced by numeral 45. As described above, pin connector 10 includes a center generally cylindrical collar 11 having a pair of generally cylindrical pins 12 and 22 extending in opposite directions therefrom As is also described above, pins 12 and 22 define respective expansion grooves 13 and 23 and respective elongated ribs 14 and 24. Beam 45 is illustrative of conventional construction toy beam elements which, as an alternative to coupler elements such as couplers 30 and 40 (shown in FIG. 1), may receive pin 10 in practicing construction toy set activity. Thus it will be understood that the present invention connector pin is not limited in its use to assembly between couplers such as couplers 30 and 40 but rather is capable of multiple configuration elements cooperation by which virtually any similarly configured construction toy element may be conveniently secured as complex structures are formed. Thus, by way of example, beam 45 which is of conventional fabrication defines an elongated rectangular body 46 having a socket 48 formed at the end wall thereof. Socket 48 further defines a notch 47 and a groove 49 in opposite positions with respect to socket 48. Thus in the typical assembly of pin connector 10 to an element having a socket end such as beam 45, pin connector 10 is aligned such that collar 11 coincides generally within the surface 50 of beam 45 and such that pin 22 is generally aligned with the sides of notch 47. Thereafter, pin connector 10 is forced upwardly through notch 47 forcing pin 22 into socket 48. Once again, in the preferred fabrication of beam 45, a molded plastic material is utilized which is substantially rigid while exhibiting a resilient characteristic. Accordingly, in the preferred fabrication of the present invention, the fit of pin 22 through notch 47 is a tight fit requiring that beam 45 deform slightly as pin 22 passes therethrough after which pin 22 is snugly received within socket 48 in the same manner as described above for pin 12 within bore 32 (seen in FIG. 3). In this manner, a snug pivotal coupling is provided which utilizes the tight fit of pin 22 within socket 48 together with the contact or collar 11 against surface 50 to maintain a convenient secure attachment allowing pin 12 to extend outwardly from the end of beam 45. In some circumstances, it may be preferable to inhibit the rotation of pin 22 within socket 48. When so desired, pin 22 is rotated prior to insertion such that rib 24 is received within groove 49 of beam 45 as pin 22 is received within socket 48. The interaction of rib 24 and groove 49 provides a resistance to rotation.

Figure 5:
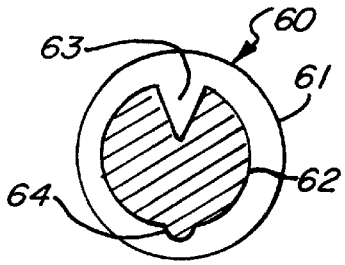
FIG. 5 sets forth a section view of an alternate embodiment of the present invention pin connector.

FIG. 5 sets forth a section view of an alternate embodiment of the present invention pin connector wherein the alternate embodiment pin connector is generally referenced by numeral 60. Pin connector 60 is substantially to pin connector 10 described above with the difference being found in the shape of groove 63. Thus pin connector 60 includes a generally cylindrical collar 61 and a generally cylindrical pin 62 extending therefrom. While not shown in FIG. 5, it will be understood that pin connector 60 further defines an identical generally cylindrical pin extending in the opposite direction or pin 62 in the manner shown for pins 12 and 22 of pin connector 10 (seen in FIG. 4). Pin 62 defines an elongated rib 64 extending substantially the length thereof and a generally V-shaped groove 63 on the opposite side with respect to rib 64. Thus it will be seen that groove 63 replaces expansion groove 13 of pin connector 10 (seen in FIG. 4). The operation of pin connector 60 is substantially identical to that described above in that rib 64 compresses or deforms slightly during pin insertion and expansion groove 64 deforms to allow pin 62 to be forcibly inserted into a cooperating bore within a construction toy set element in the same manner as described above for groove 13 of pin 12 (seen in FIG. 3).

What has been shown is a pin connector for construction toy set which provides a low cost, highly effective interconnecting pin for use in connecting various construction toy elements using a simple forced insertion assembly. The resulting connection which the present invention pin connector provides between cooperating toy set elements is a rigid secure attachment which nonetheless allows pivotal movement of the attached elements to alternative angular relationships. The connector pin is readily formed of low cost molded plastic using mass production fabrication such as injection molding or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A construction toy set comprising:

a plurality of couplers each defining a bore therethrough, said bore defining a generally smooth cylindrical surface free of any projecting elements; and a pin connector having, an elongated generally cylindrical body defining a generally cylindrical outer surface, a generally cylindrical collar having a diameter substantially greater than said elongated body integrally formed with said elongated body at the approximate midpoint thereof to divide said elongated body into first and second opposed pins each defining a pin diameter, first and second ribs extending outwardly from said collar upon said first and second opposed pins and integrally formed therewith, first and second grooves formed in said first and second opposed pins extending outwardly from said collar and defining a depth less than one half said pin diameters, said first and second grooves being positioned upon said first and second pins on the opposite sides from said first and second ribs, said first and second opposed pins being constructed and sized with respect to said bores to insert said first and second opposed pins into the respective bores of a pair of said couplers in a force fit in which said ribs, said collar and said grooves cooperate to provide a rotatable attachment between said couplers spaced apart by said collar and in which said grooves contract and said ribs compress to force said pins against said generally smooth cylindrical surface at said grooves.

* * * * *